US005386357A

United States Patent [19]

Tryon et al.

[11] Patent Number: 5,386,357

[45] Date of Patent: Jan. 31, 1995

[54] LIGHT BOX

[75] Inventors: John F. Tryon, Houston, Tex.; Jennings M. Ledbetter, Long Beach, Calif.

[73] Assignee: Shell Oil Company, Houston, Tex.

[21] Appl. No.: 985,778

[22] Filed: Dec. 4, 1992

[51] Int. Cl.[6] ..... F21S 1/02

[52] U.S. Cl. ..... 362/362; 362/219; 362/223; 362/225

[58] Field of Search ..... 362/146, 147, 148, 151, 362/152, 219, 223, 224, 225, 249, 362, 217

[56] References Cited

U.S. PATENT DOCUMENTS

| | | | |
|---|---|---|---|
| 1,843,844 | 2/1932 | Slough | 362/151 |
| 1,922,786 | 8/1933 | Thompson | 362/151 |
| 2,298,824 | 10/1942 | Darley | 362/219 |
| 2,337,685 | 12/1943 | Schepmoes . | |
| 2,810,823 | 10/1957 | Guth, Jr. | 362/224 |
| 3,675,006 | 7/1972 | Zagel et al. . | |
| 3,748,461 | 7/1973 | Wilson et al. | 362/235 |
| 4,287,555 | 9/1981 | Stilling . | |
| 4,298,916 | 11/1981 | Shemitz | 362/224 |
| 4,533,981 | 8/1985 | Radek . | |
| 4,831,759 | 5/1989 | Hosey | 362/223 |
| 4,998,188 | 3/1991 | Degelmann | 362/147 |
| 5,001,613 | 3/1991 | Foster et al. | 362/223 |
| 5,020,252 | 6/1991 | De Boef . | |

FOREIGN PATENT DOCUMENTS

| | | | |
|---|---|---|---|
| 606874 | 10/1960 | Canada | 362/147 |
| 2654188 | 5/1991 | France | 362/362 |
| 1394379 | 5/1975 | United Kingdom | 362/217 |

*Primary Examiner*—Ira S. Lazarus
*Assistant Examiner*—Y. Quach
*Attorney, Agent, or Firm*—Timothy J. Hadlock

[57] ABSTRACT

The invention relates to a light box including (a) a plurality of elongated L-shaped top sections abutted length-wise end-to-end, each of the top sections having a top flange substantially horizontally oriented and an integral back flange substantially vertically oriented; and (b) a plurality of bottom sections where the bottom sections are attached to the top sections; and (c) a single elongated translucent lens slidably secured between the outer edges of the top and bottom sections.

6 Claims, 3 Drawing Sheets

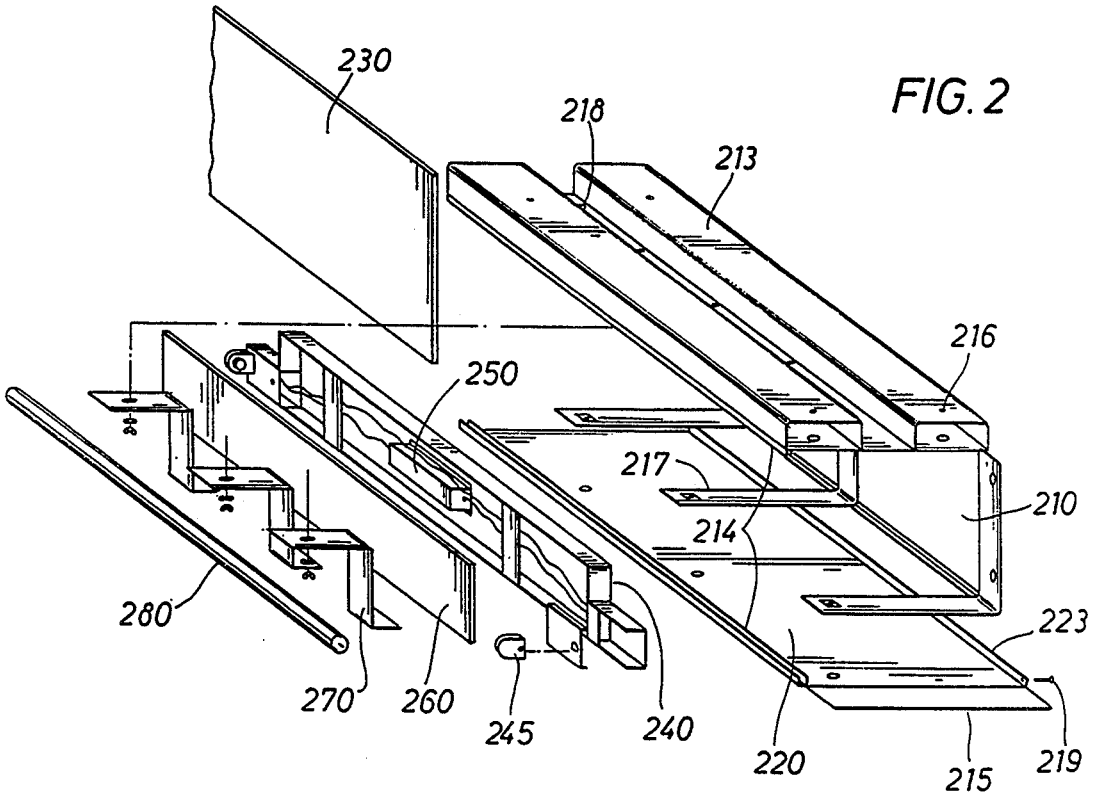
FIG. 2
FIG. 7
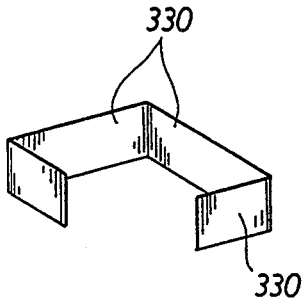

FIG. 8
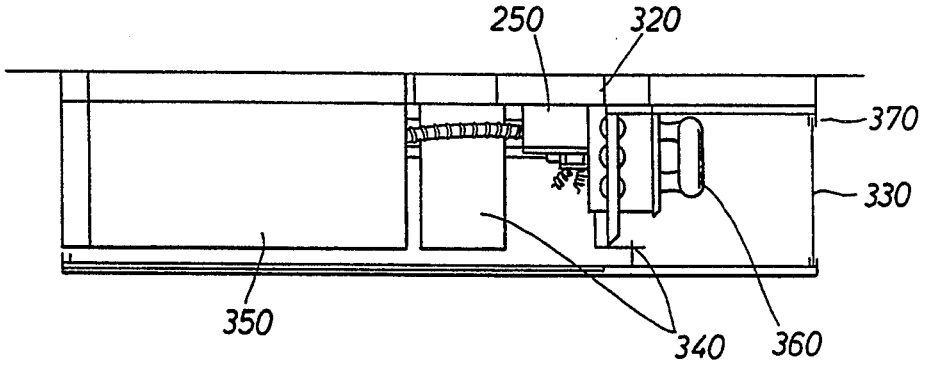
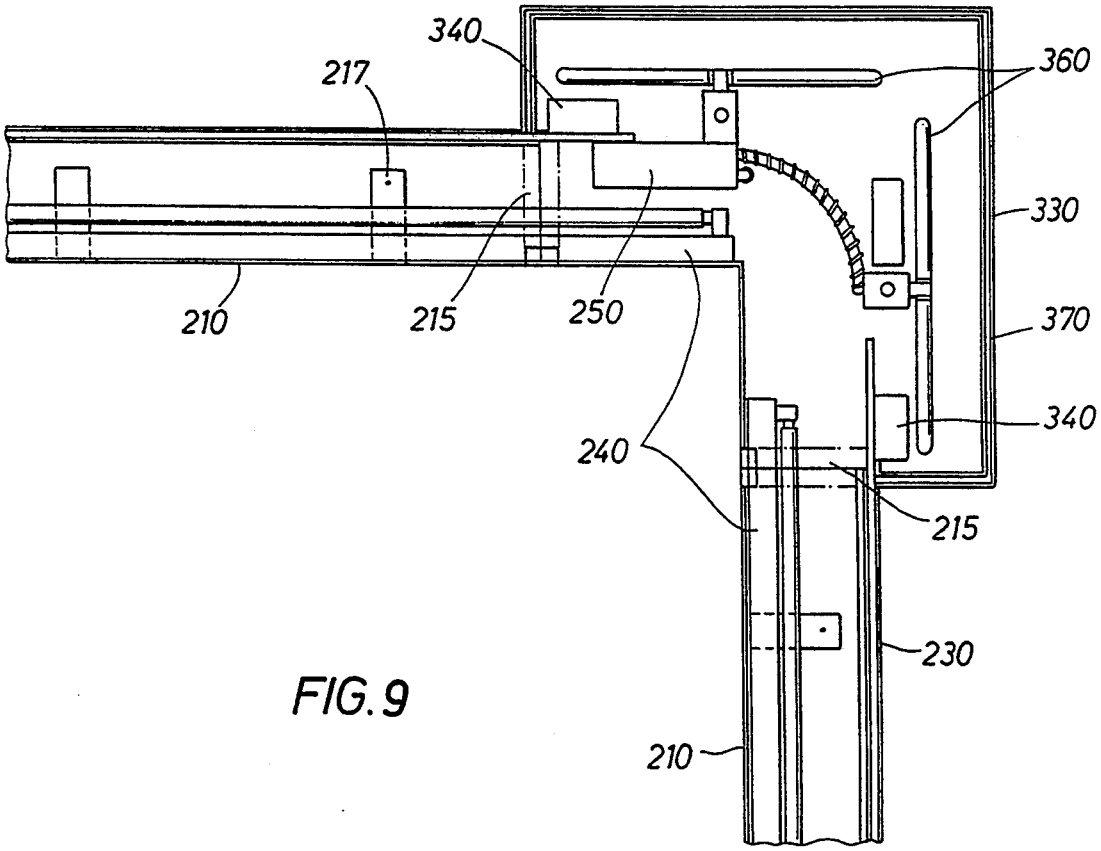
FIG. 9

LIGHT BOX

FIELD OF THE INVENTION

The invention relates to a lighting system for attachment to a roof, roof line, wall, or ceiling of a structure, or to a protective canopy structure.

BACKGROUND OF THE INVENTION

Canopies are used in gasoline service stations to cover the fuel pump area. This protects customers and employees from the weather as they pump gasoline and service the vehicle. Fluorescent or incandescent light fixtures may be provided in the ceiling of the canopy to provide partial lighting as needed. However it is also desirable to have peripheral lighting around the canopy. Desirable features of such lighting are continuous lighting, economical cost, ease of installation, ease of manufacture, and ease of maintenance. Accordingly, it would be advantageous to have such a lighting fixture available to provide peripheral lighting.

SUMMARY OF THE INVENTION

The invention relates to a lighting system for use with a raised roof or canopy. Raised canopies over gasoline service stations typically have down lighting for illuminating the work area beneath a canopy. The lighting system of the invention provides peripheral lighting for a canopy. By use of a series of light box side sections and corner sections a single lens may be used for each side to extend along substantially the entire length of each side of a canopy. By use of a single lens for each side of the canopy and by overlapping the ends of the bulbs, an unbroken continuous light strip is provided with substantially no dark spots along each side. The corner sections are used to receive expansion of the lens due to thermal changes.

One aspect of the invention is a light box including (a) a plurality of elongated L-shaped top sections abutted length-wise end-to-end, each of the top sections having a top flange substantially horizontally oriented and an integral back flange substantially vertically oriented; and (b) a plurality of bottom sections wherein one bottom section is attached to each of the top sections; and (c) a single elongated translucent lens slidably secured between the outer edges of the top and bottom sections.

BRIEF DESCRIPTION OF THE DRAWINGS

FIGS. 2 and 3 depict a portion of a side section in two embodiments.

FIG. 7 is an isometric view of one embodiment of the corner lens.

FIG. 8 depicts a view of one embodiment of a side vertical view of the top assembly and bottom panel of the light box corner section.

FIG. 9 depicts a view of one embodiment showing the positioning of the elongated lenses in the mating of the corner section and side sections.

DETAILED DESCRIPTION OF THE INVENTION

A. Side Section

Figure 1:
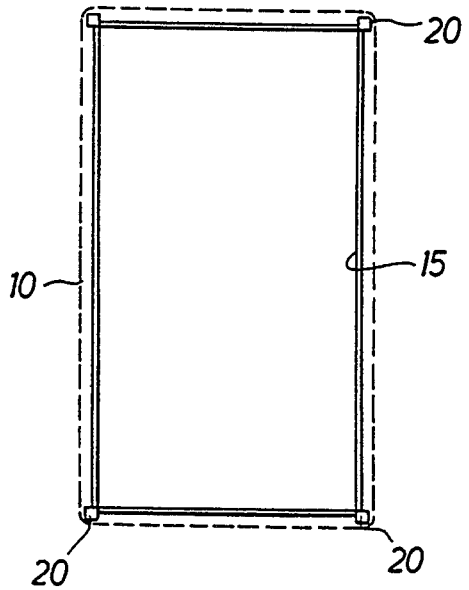
FIG. 1 is a view of one embodiment of the overall lighting system viewed from the bottom.

The side section used in one embodiment of the invention is discussed in detail below. In FIG. 1 under canopy 10, four light box side sections 15 and four light box corner sections 20 are interconnected to form a complete quadrilateral-shaped peripheral lighting system/light strip.

FIG. 2 shows the details of a section of light box side section 15 having top section 210 and bottom section 220. Top section 210 is an L-shaped configuration forming the top and back of the light box. The top section has a top flange substantially horizontally oriented and an integral back flange substantially vertically oriented. The top and back in one embodiment form substantially a 90 degree angle. The width of the top is from about 2 inches to about 24 inches. The back is typically about the same height as the height of the elongated translucent lens 230 ("side section lens" or "elongated translucent lens of the light box side section") discussed below. The height of the back is from about 2 inches to about 62 inches. A suitable height is from about 3 inches to about 18 inches or from about 3 inches to about 10 inches. A bottom flange 223 is integrally formed from the rear edge of the of the bottom section 220. This bottom flange 223 is for connection of the bottom section 220 to the integral back flange of the top section 210 optionally by horizontally oriented sheet metal screws through holes 219 in both the top and the bottom sections.

An L shaped or U shaped support bracket 217 can be attached to the top section for additional support in attaching the bottom section. By adjusting the bolt 222 used to attach the bottom section to the support bracket 217, any height fluctuation in the canopy ceiling can be overcome to make the bottom section level. This is useful so as to avoid binding when inserting the side section lens.

Both the top and bottom sections have light guards 215 attached to one end for preventing light from escaping other than through the side section lens 230. The side sections are connected end to end and the light guards permit the sections to overlap. Tracks 214 are attached to or optionally integrally formed on both the top and bottom sections. The tracks can be channels for receipt of the side section lens 230. That is, the top edge of lens 230 is slidably secured in the track of top section 210 and the bottom edge of lens 230 is slidably secured in the track of bottom section 220. Alternatively, the lens edges may have an integral slot on each edge which fits on a thin edged track. The top section optionally contains electric access holes 218. The top and bottom sections, including the tracks, are made of any durable, weather resistant material, such as metal, e.g., aluminum or steel, or plastic. The preferred material is carbon steel due to its strength and economical price.

The top section also optionally contains on its top portion spacing means 213. This may be in the form of a U-shaped strip of metal attached to the top of the top section. Through mounting holes 216 the top section is mounted beneath the canopy. The spacing means 213 is used where there is a downward directed lip on the edge of the canopy that would obscure the lighting system if it were not dropped downward beneath the bottom of the lip by the spacing means 213.

Electrical raceway 240 contains ballast 250 and socket 245 is attached to the raceway or raceway cover, wherein the portion of the socket for receiving the bulb is outside the raceway. It is covered, at least in part, by electrical raceway cover 260. The electrical raceway and cover are mounted against the back of the top section 210 optionally by mounting brackets 270. Where mounting brackets 270 are used they are held in place by typical fasteners such as bolts and nuts, including wing nuts, sheet metal screws, machine bolts, etc. through the top portion of the top section 210, optionally used with washers. Either fluorescent or neon lighting is used to provide a continuous strip of light. Neon lighting requires one or more transformers. Fluorescent lights are typically used for their cost efficiency. Fluorescent bulb 280 is connected to sockets 245. The side section lens 230 is slidable through the tracks 214.

The side section lens 230 can be made of any of a variety of plastics. For example, in one embodiment polycarbonate or acrylic can be used in the form of a plastic sheet. If desired the plastic can be pigmented. The side section lens is from about 2 inches to about 60 inches in height and is typically from about 2 inches to about 18 inches in height.

Where the lens exceeds about 18 inches in height it can bow under its own weight if not supported at the top. Therefore at heights above about 18 inches the lens is supported at the top. This is done, for example, by using set screws placed periodically through the back of the upper track. The set screws go through slots in the lens cut near the top of the lens. Another method is periodically placing pressure resistant friction clips in the upper track. The top of the lens is then held in place by these clips.

The side section lens is from about 1/32 inches to about 3/16 inches in thickness and from about 10 feet to about 220 feet in length. The lens typically is fixedly secured at one point substantially at the center of each of the light strip side sections to permit thermal expansion and contraction outwardly from the center equally in each direction.

Figure 3:
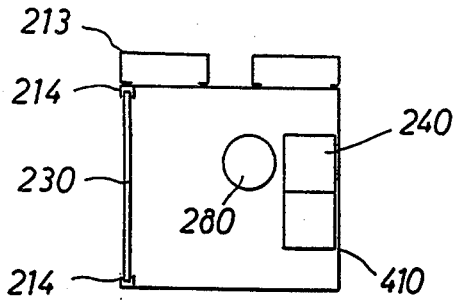

FIG. 3 depicts a variation on the embodiment of the side section of FIG. 2. Instead of an L-shaped top section and separate bottom section the top and bottom are made from a single piece of material in the form of elongated C-shaped members 410. They will have a top flange, a bottom flange, and a vertical interconnecting portion connecting the top and bottom flanges at the inner edges thereof. All of the electrical lighting arrangements and lens details are the same as discussed above in regard to FIG. 2.

Figure 4:
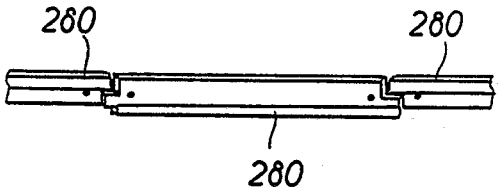
FIG. 4 is frontal view of one embodiment of a side section showing the light bulb arrangement.

FIG. 4 depicts the overlapping arrangement of fluorescent lights 280. The overlap should be an amount sufficient to maintain a continuous line of light through the lens even when the lights begin to darken at their ends due to aging. This overlap is typically from about 1 inches to about 3 inches.

B. Corner Section

A corner section is another aspect of the invention. It is discussed in detail below. The use of the corner section permits the side section lens of the side section to lengthen and shorten due to thermal expansion and yet still maintain a continuous strip of illuminated lens. This is accomplished by adapting the corner piece so that the ends of the lens of the side section slide into the corner section out of sight.

Figure 5:
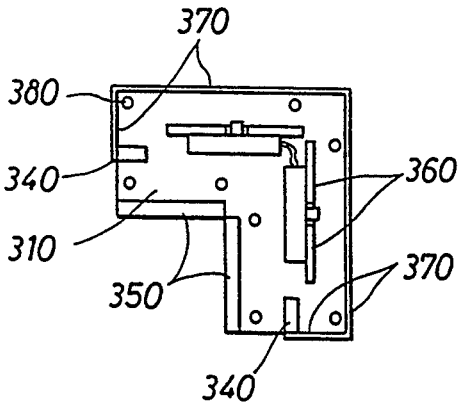
FIG. 5 is a bottom view of one embodiment of the top assembly of a corner section.
Figure 6:
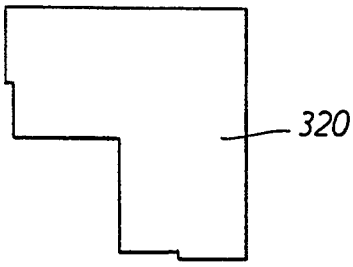
FIG. 6 is a top view of one embodiment of the bottom panel of a corner section.

FIGS. 5 and 6 show the top assembly and bottom panel of the corner section 20. The light box corner section has three main parts: a top assembly 310, a bottom panel 320, and a corner section elongated translucent lens 330 ("corner section lens"). Top assembly 310 is in an L-shaped configuration attached to the ceiling of the raised canopy by, e.g., screw or bolt through mounting holes 380. Bottom panel 320 has an L-shaped configuration and is attached to the top assembly by any conventional attachment means such as vertical standoff brackets 340 which are attached to top assembly 310. Other conventional means for attaching the bottom panel to the top assembly include bolting threw a spacer tube or welding.

The top assembly and bottom panel are typically made of the same material as the top and bottom sections of the side section 15 described above. The dimensions of the top assembly and bottom panel should be proportional to the dimensions of the side section 15. For example, when the width/height of the side section is from about 5 inches to about 8 inches, then the length of the two outer edges of the L-shaped corner section is from about 20 inches to about 40 inches. The depth of the two sides would be from about 10 inches to about 20 inches.

The corner section lens 330, depicted in FIG. 7, is secured between at least a portion of the outer edges of the top assembly and bottom panel. The corner section lens 330 can be made of the same material and have the same height and thickness dimensions as the side section lens 230 described above. The length will be from about 1 feet to about 6 feet. The top assembly and bottom panel have tracks around a portion of their perimeter for receipt of the corner section lens. That is, the top edge of corner section lens 330 is secured in the track of top assembly 310 and the bottom of corner section lens 330 is secured in the track of bottom panel 320. These tracks can be constructed as discussed above regarding the tracks of the side sections.

The corner section can have a vertical flange 350 extending downwardly from each of the two inner edges of the L-configured top assembly 310. These vertical flanges are aligned with the back portion of the side sections when the side and corner sections are joined. Each vertical flange 350 together with one of the vertical standoff brackets 340 define the width of an opening adapted to receive the end of the light box side section 15. As mentioned above, the top section 210 and bottom section 220 of the side section typically will line up with top assembly 310 and bottom panel 320 of the corner section. The back portion of the top section 210 of the side section will align with the vertical flange 350 of the top assembly 310 of the corner section.

The side section lens 230 of the side section will align just behind the vertical standoff bracket 340. The side section lens 230 is free to lengthen and shorten into or out of the corner section due to thermal expansion and contraction. It is necessary to know the expansion and contraction characteristics of the material used for the side section lens 230 and the temperature ranges to which the lens will be exposed. With this information it is known to one skilled in the art how to determine how much excess lens length is needed during installation for extension into the corner section so that it will remain in the corner section during contraction.

For example, for a polycarbonate or acrylic lens the approximate expansion would be about three inches per 100 feet of lens where the temperature increases from about 70° F. to about 150° F. The approximate contraction would be about three inches per 100 feet of lens where the temperature decreases from about 70° F. to about −20° F. Due to the much shorter length of the corner section lens 330 of the corner section there is no need to provide for its thermal expansion and contraction.

The light box corner section has at least one and typically from two to four fluorescent lights 360 for illuminating through the corner section lens. These lights are typically attached to the top assembly 310. The lights are positioned between the vertical standoff brackets 340 and the corner section lens 330. The lights 360 must be in front of the vertical standoff brackets and in Front of any end piece of side section lens 230 so that the side section lens and standoff brackets do not interfere with the lights 360 from illuminating the corner section lens 330. With this arrangement both the side section lens and corner section lens are continuously illuminated.

The corner section lens is formed along its width at three places thereby permitting the corner section lens to be bent around the outer three corners of the L-shaped configuration of the top assembly and bottom panel. The Forming may be by any conventional means such as heat forming. With this arrangement each end of the corner section lens will abut a portion of the side section lens where it enters the corner section. This permits the appearance of a continuous line of light.

C. Assembly

The following describes one method of assembling the lighting system of the invention. However, the described order of assembly is not critical and should not be construed as limiting. The top assembly of the corner sections are optionally first attached to the canopy. Where the two part side sections of FIG. 2 are used, the top L-shaped section is then attached to the canopy. The L-shaped top sections are typically in lengths sufficient to allow one person to lift and install them. Lengths of from about 2 feet to about 9 feet are typical for this purpose. A number of the L-shaped top sections are joined end to end sufficient to go along one side of the canopy, from one corner section to another. Depending on the length of each side of the canopy it may be necessary to make one L-shaped top section shorter than the others in order to extend substantially the length of the side from corner section to corner section.

The electrical raceway and sockets are then mounted to the back portion of the L-shaped top sections. The bottom sections are then attached to the back of the L-shaped top sections. After the bottom sections are attached the fluorescent bulbs are installed in the side sections. Then the side section lens is slid through the tracks along the entire length of the series of side sections. Next the fluorescent light bulbs are placed in the corner sections and the corner section lens is held up against the top assembly of the corner section while the bottom panel of the corner section is attached.

The bottom sections of the side sections are removed as necessary to replace bulbs or ballasts when they need changing. Similarly, the bulbs or ballasts of the corner sections are accessed by removing the bottom panel of the corner section. Since there are multiple bottom sections to the side section, it is not necessary to remove the side section lens when replacing bulbs or ballasts. The side section lens will be held in place by adjacent side sections even when one bottom section is removed.

What is claimed is:

1. A quadrilateral-shaped light strip for peripheral illumination of a ceiling of a four-sided raised canopy of a gasoline service station comprising:

(a) four light strip side sections each comprising light boxes comprising:

(1) a plurality of elongated L-shaped top sections abutted length-wise end-to-end, each of said top sections having outer edges and a top flange substantially horizontally oriented and an integral back flange substantially vertically oriented; and (2) a plurality of bottom sections, each having an integral flange substantially vertically oriented, each having outer edges, wherein the integral flanges of said bottom sections are attached to said integral back flanges of said top sections; and (3) a single side section elongated translucent lens having end portions and having a top edge and a bottom edge, wherein said top edge of said lens is slidably secured between the outer edges of said top sections and wherein said bottom edge of said lens is slidably secured between the outer edges of said bottom sections;

wherein said light strip side sections are attached to the perimeter of said canopy in a sufficient number to substantially extend the length of each side of said canopy, wherein said elongated translucent lens of said side section extends substantially the length of each of said light strip side sections and is fixedly secured at one point substantially at the center of each of the light strip side sections wherein said elongated translucent lens of said side section is free to lengthen and shorten due to thermal expansion and contraction; and (b) four light box corner sections each comprising:

(1) a top assembly in an L-shaped configuration attached to the ceiling of the raised canopy, said top assembly having at least two vertical standoff brackets attached thereto;

(2) a bottom panel having an L-shaped configuration attached to the top assembly by said vertical brackets; and (3) a corner section elongated translucent lens having a top edge and a bottom edge, wherein said top edge of said corner section elongated translucent lens is secured between at least a portion of the outer edges of said top assembly and wherein said bottom edge of said corner section elongated translucent lens is secured between the outer edges of said bottom panel;

wherein the ends of each of said light strip side sections terminate at and abutting to said light box corner sections, wherein the end portions of each of the side section elongated translucent lenses expand and contract into said light box corner sections;

wherein the top flanges and back flanges of said L-shaped top sections and said bottom sections of said side sections are substantially aligned with said top assemblies and said bottom panels of said light box corner sections, respectively.

2. The quadrilateral-shaped light strip of claim 1 further comprising:

(1) fluorescent light sockets for receiving a fluorescent light bulb and a fluorescent light ballast secured to said plurality of L-shaped top sections; and (2) a fluorescent light bulb removably secured to said fluorescent light sockets.

3. The quadrilateral-shaped light strip of claim 2 wherein the fluorescent light bulbs are arranged to overlap one another at each end a sufficient distance to provide an uninterrupted strip of illumination even after the fluorescent bulb ends darken near the end of their life span.

4. The quadrilateral-shaped light strip of claim 1 wherein said side section and corner section elongated translucent lenses are pigmented acrylic.

5. The quadrilateral-shaped light strip of claim 1 wherein said side section elongated translucent lens is from about 2 inches to about 18 inches in height and from about 1/32 inches to about 3/16 inches in thickness and from about 10 feet to about 220 feet in length.

6. The quadrilateral-shaped light strip of claim 1 wherein said top and bottom sections of said side section are carbon steel.

* * * * *